US010025212B2

(12) United States Patent
Nishikawa et al.

(10) Patent No.: US 10,025,212 B2
(45) Date of Patent: Jul. 17, 2018

(54) TONER AND EXTERNAL ADDITIVE FOR TONER

(71) Applicant: CANON KABUSHIKI KAISHA, Tokyo (JP)

(72) Inventors: Koji Nishikawa, Susono (JP); Shuhei Moribe, Mishima (JP); Daisuke Yoshiba, Suntou-gun (JP); Kosuke Fukudome, Tokyo (JP); Shotaro Nomura, Suntou-gun (JP); Atsuhiko Ohmori, Yokohama (JP); Katsuhisa Yamazaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/414,342

(22) Filed: Jan. 24, 2017

(65) Prior Publication Data

US 2017/0212441 A1 Jul. 27, 2017

(30) Foreign Application Priority Data

Jan. 26, 2016 (JP) ..... 2016-012811

(51) Int. Cl.
*G03G 9/087* (2006.01)
*G03G 9/08* (2006.01)

(52) U.S. Cl.
CPC ..... *G03G 9/08755* (2013.01); *G03G 9/0819* (2013.01)

(58) Field of Classification Search
CPC ..... G03G 9/09716
See application file for complete search history.

(56) References Cited

U.S. PATENT DOCUMENTS

2015/0234306 A1* 8/2015 Kouyama ..... G03G 9/08764 430/109.4

FOREIGN PATENT DOCUMENTS

| | | | | |
|---|---|---|---|---|
| JO | H10268551 A | | 10/1998 | |
| JP | 4136668 B2 | | 8/2008 | |
| JP | 2011017913 A | | 1/2011 | |
| JP | 2013-083837 | * | 5/2013 | ..... G03G 9/08 |
| JP | 2013083837 A | | 5/2013 | |
| JP | 2015045859 A | | 3/2015 | |

OTHER PUBLICATIONS

Translation of JP 2013-083837 published May 2013.*

* cited by examiner

*Primary Examiner* — Peter L Vajda
(74) *Attorney, Agent, or Firm* — Canon U.S.A.Inc., IP Division

(57) ABSTRACT

A toner includes toner particles and an external additive; the external additive includes an external additive A containing fine particles of a crystalline resin or fine particles of a wax; the crystalline resin and the wax each have an urethane bond or an urea bond; and the melting point of the crystalline resin and the melting point of the wax are each from 50° C. to 130° C.

13 Claims, 2 Drawing Sheets

TONER AND EXTERNAL ADDITIVE FOR TONER

BACKGROUND OF THE INVENTION

Field of the Invention

The present disclosure relates to a toner to be used for an image forming method, such as an electrophotographic method, and to an external additive for toner.

Description of the Related Art

An increase in speed, an increase in serviceable life, promotion of energy saving, and reduction in size have been further required for an electrophotographic image forming device, and in order to respond to those requirements, in view of the increase in speed and the promotion of energy saving, a further improvement in low-temperature fixability has been required for toner. In addition, in view of the reduction in size, in order to efficiently use a filled toner without any waste, a further improvement in transferability has been required. The reason for this is that when the transferability of toner is improved, the capacity of a residual toner container which recovers a residual transfer toner can be reduced.

From the points described above, in order to satisfy stable low-temperature fixability and transferability, various types of toners have been proposed.

Japanese Patent Laid-Open No. 2011-17913 has disclosed that when crystalline resin fine particles are externally added to toner particles, the low-temperature fixability can be improved. Japanese Patent No. 04136668 has disclosed that when fine particles of a crystalline polyester resin are provided on surfaces of toner particles, the low-temperature fixability and the durability can be improved. Japanese Patent Laid-Open No. 2013-83837 has disclosed that when crystalline resin fine particles having surfaces to which inorganic fine particles are adhered are adhered to surfaces of toner particles, the image density can be improved. Japanese Patent Laid-Open No. 2015-45859 has disclosed that when organic-inorganic composite fine particles in which inorganic fine particles are embedded in crystalline resin fine particles are externally added to surfaces of toner particles, the developability, the storage stability, and the low-temperature fixability can be improved.

According to the toners disclosed in the above documents, a certain effect on the low-temperature fixability of toner is confirmed. However, through intensive research carried by the present inventors, in consideration of the increase in speed, the increase in serviceable life, the promotion of energy saving, and the reduction in size, it was found that simultaneous satisfaction of the low-temperature fixability and the transferability is important and that the toners described above are still required to be further improved.

SUMMARY OF THE INVENTION

The present disclosure provides a toner and an external additive for toner, each of which is excellent in low-temperature fixability and transferability, even if the speed of an image forming device is increased.

The present disclosure relates to a toner comprising an external additive and toner particles each containing a binder resin and a colorant;

the external additive includes an external additive A containing a fine particle of a crystalline resin or a fine particle of a wax;

the crystalline resin and the wax each have an urethane bond or an urea bond; and the melting point of the crystalline resin and the melting point of the wax are each from 50° C. to 130° C.

In addition, the present disclosure relates to an external additive for toner, comprising a fine particle of a crystalline resin or a wax;

the crystalline resin and the wax each have an urethane bond or an urea bond; and the melting point of the crystalline resin and the melting point of the wax are each from 50° C. to 130° C.

Further features of the present disclosure will become apparent from the following description of exemplary embodiments with reference to the attached drawings.

DESCRIPTION OF THE EMBODIMENTS

Figure 1:
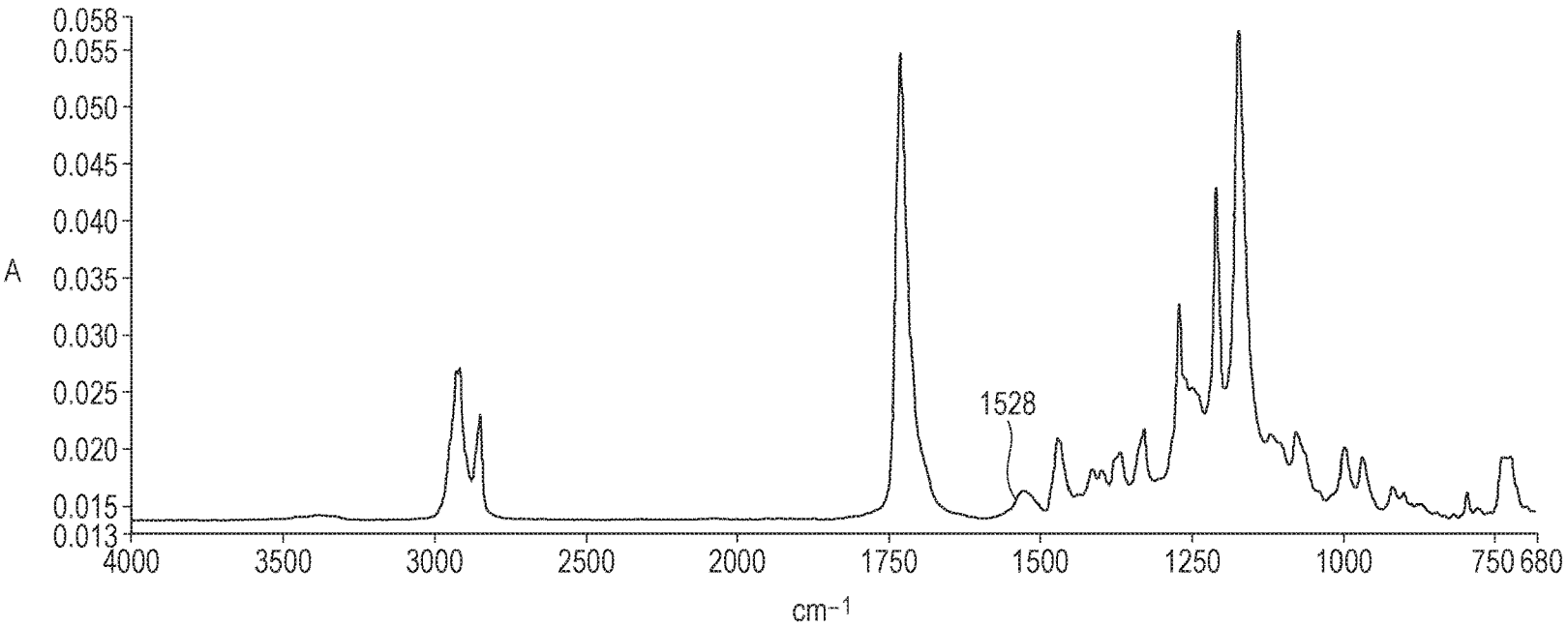
FIG. 1 is an FT-IR spectrum of a crystalline resin 1.
Figure 2:
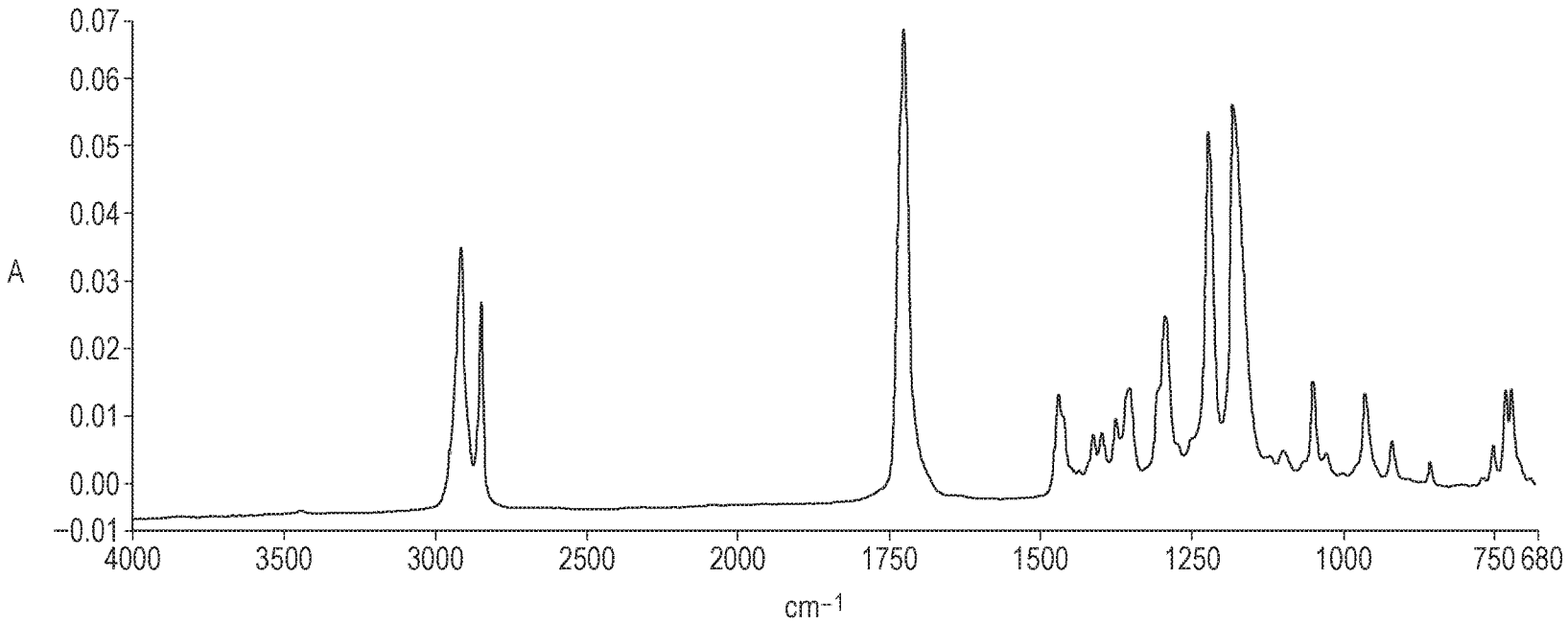
FIG. 2 is an FT-IR spectrum of a crystalline resin 11.

A toner of the present disclosure comprises an external additive and toner particles each containing a binder resin and a colorant, and the external additive includes an external additive A containing a fine particle of a crystalline resin or a fine particle of a wax. In addition, the crystalline resin and the wax each have an urethane bond or an urea bond, and the melting point of the crystalline resin and the melting point of the wax are each from 50° C. to 130° C. Even if the speed of an image forming device is increased, the use of the toner as described above has an excellent effect on the low-temperature fixability and the transferability, and the reason for this is believed to be as described below.

In a transferring step of an image forming process, a toner on a photosensitive drum is transferred on paper. In order to improve a releasing property between the photosensitive drum and the toner, for example, although a method in which the transferability is improved by external addition of a large amount of inorganic fine particles may be mentioned, the low-temperature fixability may be degraded in some cases. Hence, it was considered that when the adhesion between the toner and the paper is increased, the toner is likely to be transferred on the paper, and as a result, the transferability is improved. The paper is formed of fibers containing a cellulose as a primary component, and the cellulose has many polar groups. Hence, the present inventors assumed that when the toner contains a highly polar component, the affinity thereof with the cellulose, which is a primary component of the paper, can be increased, and as a result, the adhesion between the toner and the paper may be increased. Furthermore, the present inventors also considered that when the speed of an image forming device is increased, the transferability is effectively improved if a highly polar component is contained in the external additive.

In order to contain a highly polar component in the external additive, the external additive contains a fine particle of a crystalline resin or a fine particle of a wax, and the crystalline resin and the wax each have an urethane bond or an urea bond.

Furthermore, the present inventors considered that the use of an external additive containing a highly polar component also has an effect on the low-temperature fixability. The reason for this is that since the adhesion between an unfixed toner and paper is high, when heat is applied by a fixing device, the fixing can be more effectively performed. Since an urethane bond portion has a high polarity, the affinity thereof with paper is believed to be high. In addition, it is also believed that when the external additive contains the fine particle of the crystalline resin or the fine particle of the wax, each of which has an urethane bond, the adhesion between the toner and paper is increased, and as a result, the low-temperature fixability and the transferability are improved. In addition, when the crystalline resin or the wax, each of which has an urethane bond or an urea bond, is not used as the external additive but is contained in toner particles, a sufficient effect on the low-temperature fixability and the transferability may not be obtained.

The melting point of the crystalline resin and the melting point of the wax are each from 50° C. to 130° C., and since the melting point thereof is set in the range described above, the low-temperature fixability is improved. When the melting point is less than 50° C., the durability is liable to be degraded. When the melting point is more than 130° C., the effect on the low-temperature fixability is not likely to be obtained. When having a glass transition point (Tg) in a range of from 50° C. to 130° C. instead of having the melting point, the crystalline resin and the wax are each not likely to be spontaneously fused by heat applied by a fixing device, and hence, the effect on the low-temperature fixability is not likely to be obtained. The melting point of the crystalline resin and the melting point of the wax are each preferably from 55° C. to 130° C. and more preferably from 60° C. to 100° C.

The crystalline resin or the wax, each of which has an urethane bond, can be obtained by an urethane reaction between a compound having an isocyanate component and a crystalline resin or a wax. As a method for performing an urethane reaction, preparation may be performed in such a way that an isocyanate component is allowed to react with an alcohol at a terminal of the crystalline resin or the wax. As a method for performing an urea reaction, preparation may be performed in such a way that after the terminal of the crystalline resin or the wax is modified to have an amino group, an isocyanate component is further allowed to react therewith.

As the amine, for example, a diamine, an amine having at least trivalence, an aminoalcohol, an aminomercaptan, an amino acid, or a compound in which the above amino group is blocked may be mentioned. As the diamine, there may be mentioned an aromatic diamine, such as phenylenediamine, diethyl toluenediamine, or 4,4'-diaminodiphenylmethane; an alicyclic diamine, such as 4,4'-diamino-3,3'-dimethylcyclohexylmethane, diaminocyclohexane, or isophoronediamine; or an aliphatic diamine, such as ethylenediamine, tetramethylenediamine, or hexamethylenediamine. As the amine having at least trivalence, for example, there may be mentioned diethylenetriamine or triethylenetetramine. As the aminoalcohol, for example, there may be mentioned ethanolamine or hydroxyethylaniline. As the aminomercaptan, for example, there may be mentioned aminoethylmercaptan or aminopropylmercaptan. As the amino acid, for example, there may be mentioned aminopropionic acid or aminocaproic acid. As the compound in which the amino group is blocked, for example, there may be mentioned a ketimine compound in which an amino group is blocked by a ketone, such as acetone, methyl ethyl ketone, or methyl isobutyl ketone, or an oxazoline compound.

As the compound containing an isocyanate component, for example, there may be mentioned an aromatic diisocyanate having 6 to 20 carbon atoms (excluding carbon atoms in a NCO group, the same can also be applied to the following compound), an aliphatic diisocyanate having 2 to 18 carbon atoms, an alicyclic diisocyanate having 4 to 15 carbon atoms, a modified compound of each of those diisocyanates mentioned above (modified compound containing an urethane group, a carbodiimide group, an allophanate group, an urea group, a biuret group, a urethdione group, a uretoimine group, an isocyanurate group, or an oxazolidone group; hereinafter, also referred to as a modified diisocyanate), or a mixture containing at least two of the compounds mentioned above.

As the aliphatic diisocyanate, for example, there may be mentioned ethylene diisocyanate, tetramethylene diisocyanate, hexamethylene diisocyanate (HDI), or dodecamethylene diisocyanate.

As the alicyclic diisocyanate, for example, there may be mentioned isophorone diisocyanate (IPDI), dicyclohexylmethane-4,4'-diisocyanate, cyclohexylene diisocyanate, or methylcyclohexylene diisocyanate.

As the aromatic diisocyanate, for example, there may be mentioned m- and/or p-xylylene diisocyanate (XDI) or α,α,α',α'-tetramethylxylylene diisocyanate.

Among those mentioned above, the aromatic diisocyanate having 6 to 15 carbon atoms, the aliphatic diisocyanate having 4 to 12 carbon atoms, or the alicyclic diisocyanate having 4 to 15 carbon atoms is preferably used. In particular, HDI, IPDI, and XDI are preferable. Besides the aforementioned diisocyanates, a compound having at least three isocyanate groups may also be used.

In view of the strength of the crystalline resin, the crystalline resin is preferably a polyester resin (crystalline polyester). Since the polyester resin also has a polarity, the adhesion between the external additive and paper is increased, and the low-temperature fixability and the transferability are likely to be improved. In addition, since the polyester resin is excellent in sharp meltability, the low-temperature fixability is likely to be improved. Furthermore, since the polyester resin has a terminal alcohol, an urethane reaction is likely to occur. When having no terminal alcohol, a crystalline resin may be used after the terminal thereof is alcohol-modified.

The crystalline polyester may be obtained by condensation polymerization between an aliphatic diol functioning as an alcohol component and an aliphatic dicarboxylic acid functioning as an acid component.

As the aliphatic diol, for example, there may be mentioned 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, or 1,20-eicosanediol. Those diols may be used alone, or at least two thereof may be used in combination.

In addition, as the aliphatic diol, an aliphatic diol having a double bond may also be used. As the aliphatic diol having a double bond, for example, there may be mentioned 2-butent-1,4-diol, 3-hexene-1,6-diol, or 4-octene-1,8-diol.

As the aliphatic dicarboxylic acid, for example, there may be mentioned oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanediacrboxylic acid, 1,16-hexadecanedicarboxylic acid, 1,18-octadecanedicarboxylic acid, or a lower alkyl ester or an anhydride of each of the aforementioned aliphatic dicarboxylic acids. Among those mentioned above, sebacic acid, adipic acid, 1,10-decanedicarboxylic acid, or a lower alkyl ester or an anhydride thereof is more preferable. Those dicarboxylic acids may be used alone or in combination. In addition, the aliphatic dicarboxylic acid is not limited to those mentioned above.

As the acid component of the crystalline polyester, an aromatic dicarboxylic acid may also be used. As the aromatic dicarboxylic acid, for example, there may be mentioned terephthalic acid, isophthalic acid, 2,6-naphthalenedicarboxylic acid, or 4,4'-biphenyldicarboxylic acid. Among those aromatic dicarboxylic acids mentioned above, in view of easy availability and easy formation of a polymer having a low melting point, terephthalic acid is preferable. Furthermore, a dicarboxylic acid having a double bond may also be used. For example, fumaric acid, maleic acid, 3-hexenedioic acid, or 3-octenedioic acid may be mentioned. In addition, a lower alkyl ester or an anhydride of each of the compounds mentioned above may also be used. Among those mentioned above, in view of cost, fumaric acid or maleic acid is preferable.

A method for manufacturing the crystalline polyester is not particularly limited, and the manufacturing thereof may be performed by a general polyester polymerization method in which an acid component and an alcohol component are allowed to react with each other. For example, in accordance with the type of monomer, a direct polymerization condensation or an ester exchange method may be appropriately selected for manufacturing.

The manufacturing of the crystalline polyester is preferably performed at a polymerization temperature of from 180° C. to 230° C., and if needed, a reaction system is preferably vacuumed so that a reaction is performed while water or an alcohol, which is generated in condensation, is removed.

When monomers are not dissolved or compatible with each other at a polymerization temperature, dissolution thereof may be preferably performed using a high boiling point solvent as a dissolution auxiliary agent. The polymerization condensation reaction is performed while the dissolution auxiliary agent is removed by distillation. When a monomer having a low compatibility is used in a copolymerization reaction, it is preferable that after the monomer having a low compatibility is condensed in advance with an acid or an alcohol which is to be polymerization-condensed therewith, the polymerization condensation is then performed together with a primary component.

As a catalyst usable for manufacturing of the crystalline polyester, for example, a titanium catalyst or a tin catalyst may be mentioned. As the titanium catalyst, for example, titanium tetraethoxide, titanium tetrapropoxide, titanium tetraisopropoxide, or titanium tetrabutoxide may be mentioned. In addition, as the tin catalyst, for example, dibutyltin dichloride, dibutyltin oxide, or diphenyltin oxide may be mentioned.

When the wax is used, a known wax used as a wax to be internally added to toner may be used in a manner similar to that thereof. For example, there may be used a petroleum-based wax, such as a paraffin wax, a microcrystalline wax, or a petrolatum; a montan wax; a hydrocarbon wax by a Fischer-Tropsch method; a polyolefin wax, such as a polyethylene wax or a polypropylene wax; a natural wax, such as a carnauba wax or a candelilla wax; a fatty acid, such as stearic acid or palmitic acid; an acid amide wax; or an ester wax. When an alcohol is added to the terminal of each of the waxes mentioned above, an urethane reaction is likely to occur.

A peak molecular weight of the crystalline resin is preferably from 15,000 to 60,000. When the peak molecular weight of the crystalline resin is from 15,000 to 60,000, the low-temperature fixability is likely to be improved.

In the external additive A, the number average particle diameter of primary particle is preferably from 30 nm to 500 nm. When the number average particle diameter of the primary particle is from 30 nm to 500 nm, the toner and paper are likely to be adhered to each other in a transferring step and/or a fixing step, and the effect on the transferability and the fixability is likely to be obtained. In addition, since the external additive A functions as a spacer, the durability is likely to be improved.

The external additive A containing the fine particle of the crystalline resin or the fine particle of the wax is preferably the following organic-inorganic composite fine particle (i) or (ii).

(i) An organic-inorganic composite fine particle containing the fine particle of the crystalline resin, and an inorganic fine particle embedded in the surface of the fine particle of the crystalline resin.

(ii) An organic-inorganic composite fine particle containing the fine particle of the wax, and an inorganic fine particle embedded in the surface of the fine particle of the wax.

Furthermore, in the organic-inorganic composite fine particle, the inorganic fine particle is preferably partially exposed to the surface of the fine particle of the crystalline resin or to the surface of the fine particle of the wax. Since the inorganic fine particle is embedded in the fine particle of the crystalline resin or the fine particle of the wax, the releasing property between a photosensitive drum and the toner is improved in a transferring step, and as a result, the transferability is likely to be improved. Furthermore, the strength of the external additive A is increased, and the durability is likely to be improved. The reason the strength of the external additive A is increased is believed that the inorganic fine particle embedded in the fine particle of the crystalline resin or the wax functions as a filler. In addition, although the inorganic fine particle is embedded in the fine particle of the crystalline resin or the wax, since the external additive A is present on the surfaces of the toner particles and can spontaneously receive heat from a fixing device, the low-temperature fixability is not likely to be adversely influenced.

As a method for obtaining the organic-inorganic composite fine particle, a known method may be used.

For example, in a method in which the organic-inorganic composite fine particle is formed by embedding the inorganic fine particle into the fine particle of the crystalline resin or the fine particle of the wax, first, the fine particle of the crystalline resin or the fine particle of the wax is formed. As a method for forming the fine particle of the crystalline resin or the fine particle of the wax, for example, there may be mentioned a method in which the crystalline resin or the wax is formed into a fine particle by freezing and crushing or a method in which the crystalline resin or the wax is formed into a fine particle by phase transfer emulsification after being dissolved in a solvent. In addition, as the method in which the inorganic fine particle is embedded into the fine particle of the crystalline resin or the wax, Hybridizer (manufactured by Nara Machinery Co., Ltd.), Nobilta (manufactured by Hosokawa Micron Corp.), Mechanofusion (manufactured by Hosokawa Micron Corp.), or High Flex Gral (manufactured by Earthtechnica Co., Ltd.) may be used. Since the fine particle of the crystalline resin or the fine particle of the wax is processed by one of the above apparatuses, the organic-inorganic composite fine particle in which the inorganic fine particle is embedded into the fine particle of the crystalline resin or the wax can be formed.

In addition, the organic-inorganic composite fine particle can also be formed by forming the fine particle of the crystalline resin or the fine particle of the wax by emulsion polymerization in the presence of the inorganic fine particle.

In addition, by a method in which after the crystalline resin or the wax is dissolved in an organic solvent, the inorganic fine particle is added thereto, and phase transfer emulsification is performed under this condition, the organic-inorganic composite fine particle in which the inorganic fine particle is embedded in the fine particle of the crystalline resin or the fine particle of the wax can also be formed.

The addition amount of the inorganic fine particle contained in the organic-inorganic composite fine particle is with respect to 100 parts by mass thereof, preferably from 10 to 80 parts by mass.

As examples of the inorganic fine particle contained in the organic-inorganic composite fine particle, for example, a silica fine particle, an alumina fine particle, a titania fine particle, a zinc oxide fine particle, a strontium titanate fine particle, a cerium oxide fine particle, and a calcium carbonate fine particle may be mentioned. Those fine particles may be used alone, or at least two types thereof may be used in arbitrary combination.

In particular, when a silica fine particle is used as the inorganic fine particle of the organic-inorganic composite fine particle, the organic-inorganic composite fine particle has a particularly excellent polarity, and preferable transferability and fixability can be obtained. As the silica fine particle, a fine particle, such as fumed silica, obtained by a dry method may be used, or a fine particle obtained by a wet method, such as a sol-gel method, may also be used.

In the inorganic fine particle contained in the organic-inorganic composite fine particle, the number average particle diameter of the primary particle is preferably from 5 to 100 nm. When the number average particle diameter of the primary particle of the inorganic fine particle is from 5 to 100 nm, the inorganic fine particle has an excellent function as a filler, and a preferable durability can be obtained.

In addition, the surface of the organic-inorganic composite fine particle may be processed by an organic silicone compound or the like (silicone oil). As a method for performing a surface treatment on the organic-inorganic composite fine particle with the material mentioned above, for example, there may be mentioned a method in which a surface treatment is performed on the organic-inorganic composite fine particle or a method in which an inorganic fine particle surface-treated in advance with an organic silicone compound or the like is compounded with a resin.

The toner may be used as a one-component developer and may also be used as a two-component developer together with a carrier. As the carrier to be used when a two-component developing method is performed, any known carries may be used. In particular, for example, a metal, such as surface-oxidized or un-oxidized iron, nickel, cobalt, manganese, chromium, a rare earth, or the like, or an alloy or an oxide thereof is preferably used.

In addition, a carrier in which on surfaces of carrier core particles, covering layers each formed of a styrene resin, an acrylic resin, a silicone resin, a fluorinated resin, a polyester resin, or the like are provided is preferably used.

Next, the toner particles will be described. First, the binder resin will be described.

As the binder resin, for example, a polyester resin, a vinyl resin, an epoxy resin, or a polyurethane resin may be mentioned. In particular, in order to uniformly disperse a charge control agent having a polarity, in general, a polyester resin having a high polarity is preferably contained in view of the developability.

In view of the storage stability of toner, the binder resin preferably has a glass transition point (Tg) of from 30° C. to 70° C.

The toner particles may further contain magnetic particles and may also be used as a magnetic toner. In this case, the magnetic particles may also function as a colorant.

As the magnetic particles contained in the magnetic toner, for example, there may be mentioned iron oxide, such as magnetite, hematite, or ferrite; a metal, such as iron, cobalt, or nickel; or an alloy or a mixture, in each of which at least one of the metals mentioned above and a metal, such as aluminum, copper, lead, magnesium, tin, zinc, antimony, bismuth, calcium, manganese, titanium, tungsten, or vanadium, are contained.

The average particle diameter of those magnetic particles is preferably 2 μm or less. As the content of the magnetic particles contained in the toner is with respect to 100 parts by mass of the binder resin, preferably from 20 to 200 parts by mass.

Next, the colorant will be described.

As a black colorant, for example, carbon black, grafted carbon, or a compound prepared as a black colorant using the following yellow/magenta/cyan colorants may be used. As the yellow colorant, for example, a compound represented by a condensed azo compound, an isoindolinone compound, an anthraquinone compound, an azo metal complex, a methine compound, or an allylamide compound may be mentioned. As the magenta colorant, for example, a condensed azo compound, a diketopyrrolopyrrole compound, an anthraquinone compound, a quinacridone compound, a basic dye lake compound, a naphthol compound, a benzimidazolone compound, a thioindigo compound, or a perylene compound may be mentioned. As the cyan compound, for example, a copper phthalocyanine compound and its derivative, an anthraquinone compound, or a basic dye lake compound may be mentioned. Those colorants may be used alone, or at least two thereof may be used in a solid solution state by mixing.

The colorant may be selected in consideration of the hue angle, color saturation, lightness value, weather resistance, OHP transparency, and dispersibility in toner. The addition amount of the colorant is with respect to 100 parts by mass of the binder resin, preferably from 1 to 20 parts by mass.

In the toner particles, a wax may also be further contained. As concrete examples of the wax, the following may be mentioned by way of example.

- An aliphatic hydrocarbon-based wax, such as a low molecular weight polyethylene, a low molecular weight polypropylene, a polyolefin copolymer, a polyolefin wax, a microcrystalline wax, a paraffin wax, or a Fischer-Tropsch wax.
- An oxide of an aliphatic hydrocarbon wax, such as an oxide polyethylene wax, or a block copolymer thereof.
- A plant-based wax, such as a candelilla wax, a carnauba wax, a Japan wax, or a jojoba wax.
- An animal-based wax, such as a bees wax, a lanoline, or a spermaceti wax.
- A mineral-based wax, such as an ozokerite, a ceresin, or a petrolatum.
- A wax containing an aliphatic ester, such as a montanate wax or a castor wax, as a primary component.
- A partially or fully deoxidized aliphatic ester, such as a deoxidized carnauba wax.

In order to stabilize the chargeability of the toner particles, a charge control agent is preferably used therefor. As the charge control agent as described above, an organic metal complex or a chelate compound, in each of which a central metal thereof is likely to interact with an acid group or a hydroxy group present at a terminal of the binder resin, is effective. As examples of the charge control agent, for example, a monoazo metal complex, an acetylacetone metal complex, or a metal complex or a metal salt of an aromatic hydroxycarboxylic acid or an aromatic dicarboxylic acid may be mentioned.

As concrete examples of a usable charge control agent, for example, there may be mentioned Spilon Black TRH, T-77 and T-95 (manufactured by Hodogaya Chemical Co., Ltd.), and BONTRON (registered trade name) S-34, S-44, S-54, E-84, E-88, and E-89 (manufactured by Orient Chemical Industries Co., Ltd.). In addition, a charge control resin may also be used together with the above charge control agent.

The toner may also contain an external additive other than the external additive A. In particular, in order to improve the fluidity and the chargeability of the toner, as another external additive, a fluidity improver may also be added.

As the fluidity improver, for example, the following may be used.

For example, there may be mentioned a fluorinated resin powder, such as a poly(vinylidene fluoride) powder or a polytetrafluoroethylene powder; a finely powdered silica, such as a wet process silica or a dry process silica, a finely powdered titanium oxide, a finely powdered alumina, or a processed fine powder thereof surface-treated by a silane compound, a titanium coupling agent, or a silicone oil; an oxide, such as zinc oxide or tin oxide; a composite oxide, such as strontium titanate, barium titanate, calcium titanate, strontium zirconate, or calcium zirconate; or a carbonate compound, such as calcium carbonate or magnesium carbonate.

A preferable fluidity improver is a fine powder produced by vapor phase oxidation of a silicon halogen compound, and this fine powder is so called a dry process silica or a fumed silica. For example, a pyrolytic oxidation reaction of a silicon tetrachloride gas performed in an oxygen hydrogen flame is used, and the following reaction formula is the base of this reaction.

$$SiCl_4+2H_2O+O_2 \rightarrow SiO_2+4HCl$$

In this manufacturing process, when another metal halogen compound, such as aluminum chloride or titanium chloride, is used together with a silicone halogen compound, a composite fine powder of silica and another metal oxide may also be obtained, and this composite fine powder is also included in the silica.

When the number average particle diameter of the primary particles of the fluidity improver is from 5 to 30 nm, high chargeability and fluidity are preferably obtained.

Furthermore, as the fluidity improver, a processed silica fine powder is more preferable which is obtained by performing a hydrophobic treatment on a silica fine powder produced by vapor phase oxidation of a silicon halogen compound. The hydrophobic treatment may be performed using a method similar to that of a surface treatment performed on the organic-inorganic composite fine particles or the inorganic fine particles to be used therefor.

The fluidity improver preferably has a specific surface area of from 30 to 300 $m^2/g$ measured by a BET method using nitrogen adsorption.

To 100 parts by mass of the toner particles, 0.01 to 3 parts by mass of the fluidity improver is preferably added.

The manufacturing method of the toner particles according to the present disclosure is not particularly limited, and for example, a pulverization method or a polymerization method, such as an emulsion polymerization method, a suspension polymerization method, or a dissolution suspension method, may be used.

In the pulverization method, first, the binder resin, the colorant, the wax, the charge control agent, and the like, each of which forms the toner particles, are sufficiently mixed together by a mixing machine, such as a Henschel mixer or a ball mill. Next, an obtained mixture is melted and kneaded using a heat kneading machine, such as a biaxial kneading extruder, a heating roller, a kneader, or an extruder, and subsequently, after solidification is performed by cooling, pulverization and classification are performed. As a result, the toner particles are obtained.

Furthermore, the toner particles and an external additive containing the external additive A are sufficiently mixed together by a mixing machine, such as a Henschel mixer, so that the toner can be obtained.

As the mixing machine, for example, there may be mentioned FM mixer (manufactured by Nippon Coke & Engineering Co., Ltd.); Super Mixer (manufactured by Kawata MFG Co., Ltd.); Ribocorn (manufactured by Okawara MFG. Co., Ltd.); Nauta Mixer, Turbulizer, or Cyclomix (manufactured by Hosokawa Micron Corp.); Spiral Pin Mixer (manufactured by Pacific Machinery and Engineering Co., Ltd.); or Lödige Mixer (manufactured by Matsubo Corp.).

As the kneading machine, for example, there may be mentioned KRC kneader (manufactured by Kurimoto Ltd.), Buss Co-Kneader (manufactured by Buss), TEM type extruder (manufactured by Toshiba Machine Co., Ltd.), TEX Biaxial Kneader (manufactured by The Japan Steel Works, Ltd.), PCM Kneader (manufactured by Ikegai Corp.), three-roll mill, mixing roll mill, or kneader (manufactured by Inoue MFG., Inc.), Kneadex (manufactured by Mitsui Mining Co., Ltd.), MS type pressurized kneader or Kneader-Ruder (manufactured by Moriyama MFG., Co., Ltd.), or Banbury Mixer (manufactured by Kobe Steel, Ltd.).

As the pulverizer, for example, there may be mentioned Counter Jet Mill, Micron Jet, or Inomizer (manufactured by Hosokawa Micron Corp.), IDS-type Mill or PJM-type Jet pulverizer (manufactured by Nippon Pneumatic MFG. Co., Ltd.), Cross Jet Mill (manufactured by Kurimoto Ltd.), Ulmax (manufactured by Nisso Engineering Co., Ltd.), SK JET-O-MILL (manufactured by Seishin Enterprise Co., Ltd.), Kryptron (manufactured by Kawasaki Heavy Industries, Ltd.), Turbo mill (manufactured by Turbo Corp.), or Super Rotor (manufactured by Nisshin Engineering Inc.).

As the classifier, for example, there may be mentioned Classiel, Micron classifier, or Spedic Classifier (manufactured by Seishin Enterprise Co., Ltd.), Turbo Classifier (manufactured by Nissin Engineering Inc.), Micron Separator, Turboplex (ATP), or TSP Separator (manufactured by Hosokawa Micron Corp.), Elbow Jet (manufactured by Nittetsu Mining Co., Ltd.), Dispersion Separator (manufactured by Nippon Pneumatic MFG. Co., Ltd.), or YM Micro Cut (manufactured by Yasukawa Shoji Co., Ltd.).

In addition, an external additive for toner contains a fine particle of a crystalline resin or a fine particle of a wax, the crystalline resin or the wax has an urethane bond or an urea bond, and the melting point of the crystalline resin or that of the wax is from 50° C. to 130° C.

According to the present disclosure, even if the speed of an image forming device is increased, a toner and an external additive for toner, each of which is excellent in low-temperature fixability and transferability, can be obtained.

Measurements of various physical properties of the toner and the external additive will be described.

From the toner in which the external additive A is externally added, when the physical properties of the external additive A are measured, the measurement may be performed after the external additive A is separated from the toner. The external additive A is separated by dispersing the toner in methanol with ultrasonic wave application and is then still held for 24 hours. The external additive A dispersed in a supernatant is recovered by separation from the precipitated toner particles and is then sufficiently dried, so that the external additive A is isolated.

<Measurement Method of Melting Point and Glass Transition Temperature Tg>

The melting point and the glass transition temperature Tg are measured by a thermal differential scanning analysis device "Q1000" (manufactured by TA Instruments) in accordance with ASTM D3418-82. For the temperature correction of a device detection portion, the melting point of indium and that of zinc are used, and for the correction of amount of heat, the heat of fusion of indium is used.

In particular, after approximately 5 mg of a sample (external additive A, resin particles, wax, and toner) is accurately measured, the sample is received in an aluminum-made pan, and an empty aluminum-made pan is used as a reference. By the use of those pans, the measurement is performed in a measurement temperature range of from 30° C. to 200° C. at a temperature increase rate of 10° C./min. In addition, in this measurement, after the temperature is once increased to 200° C. at a temperature increase rate of 10° C./min and is then decreased to 30° C. at a temperature decrease rate of 10° C./min, the temperature is again increased at a temperature increase rate of 10° C./min. By the use of a DSC curve obtained in the second temperature increase step, the physical properties defined in the present disclosure will be obtained.

In this DSC curve, the temperature indicating the maximum endothermic peak of the DSC curve in a temperature range of from 30° C. to 200° C. is regarded as the melting point of the sample.

In this DSC curve, the intersection between the DSC curve and the line passing through the central point between the base lines before and after the change in specific heat occurs is regarded as the glass transition temperature Tg.

<Confirmation Method of Urethane Bond of Crystalline Resin or Wax>

The presence or the absence of the urethane bond is confirmed using an FT-IR Spectrum by an ATR method. The FT-IR spectrum by the ATR method is obtained by using a Frontier (Fourier transfer infrared spectroscopic analyzer, manufactured by Perkin Elmer) equipped with an Universal ATR Sampling Accessory. As an ATR crystal, an ATR crystal (refractive index: 4.0) of Ge is used. The other conditions are as shown below.

Range
Start: 4,000 $cm^{-1}$
End: 600 $cm^{-1}$ (ATR crystal of Ge)
Scan number: 8
Resolution: 4.00 $cm^{-1}$
Advanced: with $CO_2/H_2O$ correction When the peak top is present in a range of 1,570 to 1,510 $cm^{-1}$, it is judged that the urethane bond is present (Comprehensive Data of Infrared Absorption Spectra, published by Sankyo Shuppan Co., Ltd.).

In addition, as for the urea bond, the presence or the absence of the urea bond is also confirmed by a peak top present in a specific range thereof.

<Measurement Method of Peak Molecular Weight>

The molecular weight distribution (peak molecular weight) of the crystalline resin is measured as described below using a gel permeation chromatography (GPC).

First, a sample is dissolved in tetrahydrofuran (THF) at room temperature over 24 hours. In addition, a solution obtained thereby is filtrated using a solvent-resistant membrane filter (Maeshori Disc) (manufactured by Tosoh Corp.) having a pore diameter of 0.2 μm, so that a sample solution is obtained. In addition, the sample solution is adjusted so that the concentration of a soluble component in THF is approximately 0.8 percent by mass. By the use of this sample solution, the measurement is performed under the following condition.

Apparatus: HLC8120 GPC (detector: RI) (manufactured by Tosoh Corp.)
Columns: 7 column train of Shodex KF-801, 802, 803, 804, 805, 806, and 807 (manufactured by Showa Denko K. K.)
Eluent: tetrahydrofuran (THF)
Flow rate: 1.0 ml/min
Oven temperature: 40.0° C.
Amount of injected sample: 0.10 ml In order to calculate the molecular weight of the sample, a molecular weight calibration curve formed by using standard polystyrene resins (such as trade name "TSK Standard Polystyrene F-850, F-450, F-288, F-128, F-80, F-40, F-20, F-10, F-4, F-2, F-1, A-5000, A-2500, A-1000, and A-500" manufactured by Tosoh Corp.) is used.

<Measurement Method of Number Average Particle Diameter of Primary Particle of External Additive A>

The measurement of the number average particle diameter of the primary particle of the external additive A is performed using a scanning electron microscope "S-4800" (trade name, manufactured by Hitachi Ltd.). A toner in which the external additive A is externally added is observed, and in a viewing field enlarged by at most 200,000 times, the major axes of 100 primary particles of the external additive A are randomly measured, so that the number average particle diameter is obtained. The observation magnification is appropriately adjusted in accordance with the size of the external additive A. The other external additives are also measured by a method similar to that described above.

<Measurement Method of Weight Average Particle Diameter (D4) of Toner Particles>

The weight average particle diameter (D4) of the toner particles is calculated as described below. As a measurement device, a precision particle size distribution measurement device "Coulter Counter Multisizer 3" (registered trade name, manufactured by Beckman Coulter, Inc.) having a 100-μm aperture tube is used in accordance with an aperture impedance method. The setting of the measurement conditions and the analysis of the measured data are performed by an attached dedicated software "Beckman Coulter Multisizer 3 Version 3.51" (manufactured by Beckman Coulter, Inc.). In addition, the measurement is performed by an effective measurement channel number of 25,000.

As an electrolyte aqueous solution to be used for the measurement, a solution prepared in such a way that reagent grade sodium chloride is dissolved in ion-exchanged water to have a concentration of approximately 1 percent by mass, such as "ISOTON II" (manufactured by Beckman Coulter, Inc.), may be used.

In addition, before the measurement and the analysis are performed, the above dedicated software is set as described below.

In the "change standard measurement method (SOM)" screen of the dedicated software, the total count number of the control mode is set to 50,000 particles, the number of times of measurement is set to 1, and a value obtained by using the "standard particles 10.0 μm" (manufactured by Beckman Coulter, Inc.) is set as the Kd value. The threshold and the noise level are automatically set by pressing the "threshold/noise level measurement button". In addition, the current is set to 1,600 μA, the gain is set to 2, and the electrolyte solution is set to ISOTON II, and a check mark is placed in the "flush the aperture tube after the measurement".

In the "setting for conversion from pulse to particle diameter" screen of the dedicated software, the bin interval is set at a logarithmic particle diameter, the particle diameter bin is set at 256 particle diameter bins, and the particle diameter range is set at from 2 μm to 60 μm.

A particular measurement method is as described below.

(1) The electrolyte solution in an amount of approximately 200 ml is charged into a 250-ml round-bottom beaker made of glass dedicated for Multisizer 3. The beaker is set in a sample stand, and the electrolyte solution in the beaker is stirred with a stirrer rod at 24 rotations/sec in a counterclockwise direction. Subsequently, dirt and air bubbles in the aperture tube are removed by the "aperture flush" function of the dedicated software.

(2) The electrolyte solution in an amount of approximately 30 mL is charged into a 100-ml flat-bottom beaker made of glass. A diluted solution in an amount of approximately 0.3 mL prepared by diluting "Contaminon N" (an aqueous solution at a concentration of 10 percent by mass of a neutral detergent for washing a precision measuring device, the solution containing a nonionic surfactant, an anionic surfactant, and an organic builder; having a pH of 7; and manufactured by Wako Pure Chemical Industries, Ltd.) with ion-exchanged water in an amount three times that thereof is added as a dispersant to the electrolyte solution.

(3) An ultrasonic dispersing unit "Ultrasonic Dispersion System Tetora 150" (manufactured by Nikkaki Bios Co., Ltd.) is prepared in which two oscillators each having an oscillation frequency of 50 kHz are built so that the phases thereof are shifted from each other by 180° and which has an electric output of 120 W. Ion-exchanged water in an amount of approximately 3.3 L is charged into a water bath of the ultrasonic dispersing unit, and approximately 2 mL of Contaminon N is charged into this water bath.

(4) The beaker of the above (2) is set in a beaker fixing hole of the ultrasonic dispersing unit, and the ultrasonic dispersing unit is driven. Subsequently, the height position of the beaker is adjusted so that the resonance state of the liquid level of the electrolyte solution in the beaker is maximized.

(5) The toner particle in an amount of approximately 10 mg is gradually added to and dispersed in the electrolyte solution in the beaker of the above (4) while the electrolyte solution is irradiated with an ultrasonic wave. Subsequently, the ultrasonic dispersion treatment is further continued for 60 seconds. In addition, in the ultrasonic dispersion, the temperature of water in the water bath is appropriately adjusted so as to be from 10° C. to 40° C.

(6) The electrolyte solution of the above (5) in which the toner is dispersed is dripped with a pipette to the round-bottom beaker of the above (1) placed in the sample stand, and the concentration to be measured is adjusted to approximately 5%. In addition, the measurement is performed until the number of the measured particles reaches 50,000.

(7) The measurement data is analyzed with the dedicated software attached to the device, and the weight average particle diameter (D4) is calculated. In addition, when graph/percent by volume is set in the above dedicated software, the "average diameter" on the "analysis/volume statistic value (arithmetic average)" screen indicates the weight average particle diameter (D4).

EXAMPLES

Although the present disclosure will be described in detail with reference to Examples and Comparative Examples, the present invention is not limited thereto at all. In addition, "part(s)" and "%" of the following material are each on the mass basis unless otherwise particularly noted.

A crystalline resin was formed as described below.

<Manufacturing Example of Crystalline Resin 1>

Decanedicarboxylic acid (acid component) 159 g 1,6-hexanediol (alcohol component) 90 g The above raw materials were charged into a reaction chamber equipped with a stirring unit, a thermometer, and a nitrogen introduction tube. Subsequently, after 0.1 percent by mass of tetraisobutyl titanate with respect to the total mass of the above raw materials was charged, and a reaction was then performed at 180° C. for 4 hours, the temperature was increased to 210° C. at a rate of 10° C./hour and was then held at 210° C. for 8 hours. Next, a reaction was performed at 8.3 kPa for 1 hour, so that a crystalline polyester resin 1 was obtained. The melting point and the peak molecular weight of the crystalline polyester resin 1 were 72° C. and 13,000, respectively.

Next, the crystalline polyester resin was charged into a reaction chamber equipped with a stirring unit, a thermometer, and a nitrogen introduction tube. With respect to the total mass of the acid component and the alcohol component, 14 g of hexamethylene diisocyanate (HDI) was charged as an isocyanate component, and tetrahydrofuran (THF) was added so that the concentrations of the crystalline polyester resin and HDI were each 50 percent by mass. By heating to 50° C., a urethanation reaction was performed over 10 hours. THF used as a solvent was distilled off, so that a crystalline resin 1 was obtained. Since the crystalline resin 1 had a peak top at 1,528 $cm^{1}$ by an FT-IR measurement, the presence of a urethane bond was confirmed. The melting point and the peak molecular weight are shown in Table 1. The FT-IR spectrum of the crystalline resin 1 is shown in FIG. 1.

<Manufacturing Examples of Crystalline Resins 2 to 8>

The monomer recipe was changed from that of the manufacturing example of the crystalline resin 1 to that shown in Table 1, and the reaction conditions were adjusted, so that crystalline resins 2 to 8 were obtained. The physical properties of the crystalline resins 2 to 8 are shown in Table 1.

<Manufacturing Example of Wax 9>

In the manufacturing example of the crystalline resin 1, Unilin Wax (ES844P, manufactured by BAKER PETROLITE) having a melting point of 105° C. and a peak molecular weight of 700 was used instead of the crystalline polyester resin 1, and the reaction conditions were adjusted, so that a wax 9 was obtained. The physical properties of the wax 9 are shown in Table 1.

<Manufacturing Example of Wax 10>

A maleic acid modified wax (Yumex 2000, manufactured by Sanyo Chemical Industries, Ltd.) having a melting point of 96° C. and a peak molecular weight of 14,000 was used as a wax 10. The physical properties of the wax 10 are shown in Table 2.

<Manufacturing Example of Crystalline Resin 11>

The crystalline polyester resin 1 obtained in the manufacturing example of the crystalline resin 1 was used as a crystalline resin 11. No urethane bond was present therein. The physical properties of the crystalline resin 11 are shown in Table 2. Since the crystalline resin 11 has no peak top at 1,570 to 1,510 $cm^{1}$ by an FT-IR measurement, the absence of an urethane bond was confirmed. The FT-IR spectrum of the crystalline resin 11 is shown in Table 2.

TABLE 1

| | Composition | | | | | | | | | | |
|---|---|---|---|---|---|---|---|---|---|---|---|
| | Acid component | Charge amount (g) | Alcohol component | Charge amount (g) | Wax component | Charge amount (g) | Isocyanate component | Charge amount (g) | Urethane bond | Melting point (° C.) | Peak molecular weight |
| Crystalline resin 1 | Decanedicarboxylic acid | 159 | 1,6-hexanediol | 90 | | | HDI | 14 | Yes | 68 | 24000 |
| Crystalline resin 2 | Sebacic acid | 139 | 1,9-nonanediol | 122 | | | HDI | 14 | Yes | 59 | 27000 |
| Crystalline resin 3 | Terephthalic acid | 115 | 1,6-hexanediol | 90 | | | HDI | 14 | Yes | 105 | 28000 |
| Crystalline resin 4 | Decanedicarboxylic acid | 159 | 1,6-hexanediol | 90 | | | HDI | 10 | Yes | 69 | 16000 |
| Crystalline resin 5 | Decanedicarboxylic acid | 159 | 1,6-hexanediol | 90 | | | HDI | 25 | Yes | 65 | 57000 |
| Crystalline resin 6 | Decanedicarboxylic acid | 159 | 1,6-hexanediol | 90 | | | HDI | 8 | Yes | 69 | 14000 |
| Crystalline resin 7 | Decanedicarboxylic acid | 159 | 1,6-hexanediol | 90 | | | HDI | 29 | Yes | 65 | 62000 |
| Crystalline resin 8 | Sebacic acid | 121 | 1,9-nonanediol | 122 | | | Tolylene diisocyanate | 73 | Yes | 49 | 21000 |
| Wax 9 | | | | | ES844P | 300 | HDI | 90 | Yes | 97 | 1500 |

TABLE 2

| | Urethane bond | Melting point (° C.) | Peak molecular weight |
|---|---|---|---|
| Wax 10 | No | 96 | 14000 |
| Crystalline resin 11 | No | 72 | 13000 |

Next, the external additive A was formed as described below.

<Manufacturing Example of External Additive A 1>

After 5 g of the crystalline resin 1 and 50 g of toluene were charged into a reaction chamber equipped with a stirrer, a condenser, a thermometer, and a nitrogen introduction tube, heating was performed to 60° C. for dissolution.

Subsequently, while stirring was performed, 1.5 g of a dialkyl sulfosuccinate salt (trade name: Sanmorin OT-70, manufactured by Sanyo Chemical Industries, Ltd.), 0.22 g of dimethylaminoethanol, and 8 g of an organosilica sol (silica fine particles, trade name: Organosilicasol MEK-ST-40, manufactured by Nissan Chemical Industries, Ltd., average particle diameter: 15 nm, and solid mass rate: 40%) as an inorganic fine particle were added. Subsequently, while 60 g of water was added at a rate of 2 g/min with stirring, phase transfer emulsification was performed. Next, the temperature was set to 40° C., and bubbling was performed with nitrogen at a flow rate of 100 ml/min to remove toluene, so that a dispersion liquid of an external additive A1 was obtained. The solid component concentration of the dispersion liquid was adjusted to 10%. The external additive A1 was an organic-inorganic composite fine particle including a fine particle of the crystalline resin and the inorganic fine particle embedded in the surface of the fine particle of the crystalline resin.

<Manufacturing Examples of External Additives A2 to A7 and A11>

In the manufacturing example of the external additive A1, except that the crystalline resin was changed as shown in Table 4, dispersion liquids of external additives A2 to A7 and All were each obtained by a method similar to that of the manufacturing example of the external additive A1. The solid component concentration of the dispersion liquid was adjusted to 10%. The external additives A2 to A7 and A11 were each an organic-inorganic composite fine particle including a fine particle of the crystalline resin and the inorganic fine particle embedded in the surface of the fine particle of the crystalline resin.

<Manufacturing Example of External Additive A8>

In the manufacturing example of the external additive A1, except that the organosilica sol was not used, a dispersion liquid of an external additive A8 was obtained by a method similar to that of the manufacturing example of the external additive A1. The solid component concentration of the dispersion liquid was adjusted to 10%.

<Manufacturing Example of External Additive A9>

By the use of Cryogenic Sample Crusher (Model JFC-300, manufactured by Industry Co., Ltd.), 2 g of the crystalline resin 1 was frozen and crushed using liquid nitrogen. Next, 0.5 parts of fumed silica (BET: 200 $m^2/g$) was adhered to the surface of 50 parts of the crystalline resin 1 thus frozen and crushed by external addition and mixing using an FM mixer (manufactured by Nippon Coke and Engineering Co., Ltd.). Sieving was performed using a mesh having an opening of 30 μm, so that an external additive A9 was obtained. The external additive A9 was confirmed by the observation using a scanning electron microscope that the inorganic fine particles were not embedded in the surface of the crystalline resin but were adhered thereto.

<Manufacturing Example of External Additive A10>

After 5 g of the wax 9 and 50 g of toluene were charged into a reaction chamber equipped with a stirrer, a condenser, a thermometer, and a nitrogen introduction tube, heating was performed to 70° C. for dissolution.

Subsequently, while stirring was performed, 1.0 g of a dialkyl sulfosuccinate salt (trade name: Sanmorin OT-70, manufactured by Sanyo Chemical Industries, Ltd.), 0.2 g of dimethylaminoethanol, and 8 g of an organosilica sol (silica fine particles, trade name: Organosilicasol MEK-ST-40, manufactured by Nissan Chemical Industries, Ltd., average particle diameter: 15 nm, and solid mass rate: 40%) as inorganic fine particles were added. Subsequently, while 60 g of water was added at a rate of 2 g/min with stirring, phase transfer emulsification was performed. Next, the temperature was set to 40° C., and bubbling was performed with nitrogen at a flow rate of 100 ml/min to remove toluene, so that a dispersion liquid of an external additive A10 was obtained. The solid component concentration of the dispersion liquid was adjusted to 10%. The external additive A10 was an organic-inorganic composite fine particle including a fine particle of the wax and the inorganic fine particle embedded in the surface of the fine particle thereof.

<Manufacturing Example of External Additive A12>

After 5 g of the wax 10 and 50 g of toluene were charged into a reaction chamber equipped with a stirrer, a condenser, a thermometer, and a nitrogen introduction tube, heating was performed to 70° C. for dissolution.

Subsequently, while stirring was performed, 1.1 g of a dialkyl sulfosuccinate salt (trade name: Sanmorin OT-70, manufactured by Sanyo Chemical Industries, Ltd.), 0.75 g of dimethylaminoethanol, and 8 g of an organosilica sol (silica fine particles, trade name: Organosilicasol MEK-ST-40, manufactured by Nissan Chemical Industries, Ltd., average particle diameter: 15 nm, and solid mass rate: 40%) as inorganic fine particles were added. Subsequently, while 60 g of water was added at a rate of 2 g/min with stirring, phase transfer emulsification was performed. Next, the temperature was set to 40° C., and bubbling was performed with nitrogen at a flow rate of 100 ml/min to remove toluene, so that a dispersion liquid of an external additive A12 was obtained. The solid component concentration of the dispersion liquid was adjusted to 10%. The external additive A12 was an organic-inorganic composite fine particle including a fine particle of the wax and the inorganic fine particle embedded in the surface of the fine particle thereof.

<Manufacturing Example of External Additive A13>

In the manufacturing example of the external additive A12, except that the organosilica sol was not used, a dispersion liquid of an external additive A13 was obtained by a method similar to that of the manufacturing example of the external additive A12. The solid component concentration of the dispersion liquid was adjusted to 10%.

<Manufacturing Example of External Additive A14>

After 10 g of the crystalline resin 11 and 40 g of toluene were charged into a reaction chamber equipped with a stirrer, a condenser, a thermometer, and a nitrogen introduction tube, heating was performed to 60° C. for dissolution.

Subsequently, while stirring was performed, 0.8 g of a dialkyl sulfosuccinate salt (trade name: Sanmorin OT-70, manufactured by Sanyo Chemical Industries, Ltd.), 0.17 g of dimethylaminoethanol, and 20 g of an organosilica sol (silica fine particles, trade name: Organosilicasol MEK-ST-40, manufactured by Nissan Chemical Industries, Ltd., average particle diameter: 15 nm, and solid mass rate: 40%) as inorganic fine particles were added. Subsequently, while 60 g of water was added at a rate of 2 g/min with stirring, phase transfer emulsification was performed. Next, the temperature was set to 40° C., and bubbling was performed with nitrogen at a flow rate of 100 ml/min to remove toluene, so that a dispersion liquid of an external additive A14 was obtained. The solid component concentration of the dispersion liquid was adjusted to 10%. The external additive A14 was an organic-inorganic composite fine particle including a fine particle of the crystalline resin and the inorganic fine particle embedded in the surface of the fine particle thereof.

The crystalline resins and the waxes used for the formation of the external additives A1 to A14 are shown in Table 3.

TABLE 3

| | Crystalline resin/Wax |
|---|---|
| External additive A1 | Crystalline resin 1 |
| External additive A2 | Crystalline resin 2 |
| External additive A3 | Crystalline resin 3 |
| External additive A4 | Crystalline resin 4 |
| External additive A5 | Crystalline resin 5 |
| External additive A6 | Crystalline resin 6 |
| External additive A7 | Crystalline resin 7 |
| External additive A8 | Crystalline resin 1 |
| External additive A9 | Crystalline resin 1 |
| External additive A10 | Wax 9 |
| External additive A11 | Crystalline resin 8 |
| External additive A12 | Wax 10 |
| External additive A13 | Wax 10 |
| External additive A14 | Crystalline resin 11 |

<Manufacturing Example of Toner Particles 1>

Amorphous polyester resin (Tg: 59° C., softening point Tm: 112° C.): 100 parts

Magnetic iron oxide particles: 75 parts

Fischer-Tropsch wax (C105, manufactured by Sasol, melting point: 105° C.): 2 parts Charge control agent (T-77, manufactured by Hodogaya Chemical Co., Ltd.): 2 parts After the above raw materials were pre-mixed with each other by an FM mixer (manufactured by Nippon Coke & Engineering Co., Ltd.), by the use of a biaxial extruder (trade name: PCM-30, manufactured by Ikegai Corp.), melting and kneading were performed so as to set the temperature of a melted material at an ejection port to 150° C.

After the kneaded product thus obtained was cooled and then coarsely pulverized by a hammer mill, fine pulverization was performed by a pulverizer (trade name: Turbo Mill T250, manufactured by Turbo Corp.). The finely pulverized powder thus obtained was classified by a multi-division classifier using the Coanda effect, so that toner particles 1 having a weight average particle diameter (D4) of 7.2 μm were obtained.

<Manufacturing Example of Toner 1>

External addition of the external additive A1 was performed to the toner particles 1 by a wet method. After "Contaminon N" (trade name, manufactured by Wako Pure Chemical Industries, Ltd.) was added to 2,000 parts of water, 100 parts of the toner particles 1 was dispersed therein. While the toner particle dispersion liquid thus prepared was stirred, 15 parts of the dispersion liquid (solid component concentration: 10%) of the external additive A1 was added. Subsequently, the temperature was maintained at 50° C., and stirring was continuously performed for 2 hours, so that the external additive A1 was externally added to the surfaces of the toner particles 1. Through the filtration and drying, particles in which the external additive A1 was externally added to the surfaces of the toner particles 1 were obtained. Furthermore, external addition and mixing of fumed silica (BET: 200 $m^2/g$) were performed on the particles described above by an FM mixer (manufactured by Nippon Coke & Engineering Co., Ltd.) so that the amount of the fumed silica was 1.5 parts with respect to 100 parts of the toner particles 1. In addition, the particles obtained by the external addition as described above were sieved using a mesh having an opening of 150 μm, so that a toner 1 was obtained. By the observation using a scanning electron microscope, the external additive A1 was confirmed that the number average particle diameter of the primary particle was 110 nm and that the inorganic fine particle was embedded in the fine particle of the crystalline resin. In addition, the presence or the absence of an urethane bond, the melting point, and the peak molecular weight were the same as the results shown in Table 1.

<Manufacturing Examples of Toners 2 to 8 and 10 and Comparative Toners 1 to 4>

Except that the external additive and the addition amount thereof were changed from those of the manufacturing example of the toner 1 to those shown in Table 4, toners 2 to 8 and 10 and comparative toner 1 to 4 were each obtained by a method similar to that of the manufacturing example of the toner 1. The physical properties of the toners 2 to 8 and 10 and the comparative toners 1 to 4 are shown in Table 4. In addition, by the observation using a scanning electron microscope, the external additives A2 to A7 and A10 to A12 were each confirmed that the inorganic fine particle was embedded in the fine particle of the crystalline resin or the wax. In addition, the presence or the absence of a urethane bond, the melting point, and the peak molecular weight were the same as the results shown in Table 1 or 2.

<Manufacturing Example of Toner 9>

Next, 1.5 parts of the external additive A9 and 1.5 parts of fumed silica (BET: 200 $m^2/g$) were externally added to and mixed with 100 parts of the toner particles 1 using an FM mixer (Nippon Coke & Engineering Co., Ltd.), and sieving was then performed using a mesh having an opening of 50 μm, so that a toner 9 was obtained. The physical properties of the toner 9 are shown in Table 4. In addition, by the observation using a scanning electron microscope, the external additive A9 was confirmed that the inorganic fine particles were adhered to the surfaces of the crystalline resin. In addition, the presence or the absence of an urethane bond, the melting point, and the peak molecular weight were the same as the results shown in Table 1.

<Manufacturing Example of Comparative Toner 5>

Next, 1.5 parts of fumed silica (BET: 200 $m^2/g$) was externally added to and mixed with 100 parts of the toner particles 1 using an FM mixer (manufactured by Nippon Coke & Engineering Co., Ltd.), and sieving was then performed using a mesh having an opening of 150 μm, so that a comparative toner 5 was obtained. The physical properties of the comparative toner 5 are shown in Table 4.

TABLE 4

| | | | | | External additive A | | |
|---|---|---|---|---|---|---|---|
| Toner | Toner particles | Addition amount of external additive (parts by mass to 100 parts by mass of toner particles) | | | Number average particle diameter of primary particles (mm) | Presence or absence of composite | State of inorganic fine particles in organic-inorganic composite fine particles |
| Toner 1 | Toner particles 1 | External additive A1 | 1.5 Fumed silica | 1.5 | 110 | Organic-inorganic composite fine particles | Embedded |
| Toner 2 | Toner particles 1 | External additive A2 | 1.5 Fumed silica | 1.5 | 126 | Organic-inorganic composite fine particles | Embedded |
| Toner 3 | Toner particles 1 | External additive A3 | 1.5 Fumed silica | 1.5 | 151 | Organic-inorganic composite fine particles | Embedded |
| Toner 4 | Toner particles 1 | External additive A4 | 1.5 Fumed silica | 1.5 | 98 | Organic-inorganic composite fine particles | Embedded |
| Toner 5 | Toner particles 1 | External additive A5 | 1.5 Fumed silica | 1.5 | 184 | Organic-inorganic composite fine particles | Embedded |
| Toner 6 | Toner particles 1 | External additive A6 | 1.5 Fumed silica | 1.5 | 105 | Organic-inorganic composite fine particles | Embedded |
| Toner 7 | Toner particles 1 | External additive A7 | 1.5 Fumed silica | 1.5 | 166 | Organic-inorganic composite fine particles | Embedded |
| Toner 8 | Toner particles 1 | External additive A8 | 1.5 Fumed silica | 1.5 | 195 | Resin fine particles | — |
| Toner 9 | Toner particles 1 | External additive A9 | 1.5 Fumed silica | 1.5 | 432 | Organic-inorganic composite fine particles | Adhered to surfaces |
| Toner 10 | Toner particles 1 | External additive A10 | 1.5 Fumed silica | 1.5 | 202 | Organic-inorganic composite fine particles | Embedded |
| Comparative toner 1 | Toner particles 1 | External additive A11 | 1.5 Fumed silica | 1.5 | 111 | Organic-inorganic composite fine particles | Embedded |
| Comparative toner 2 | Toner particles 1 | External additive A12 | 1.5 Fumed silica | 1.5 | 197 | Organic-inorganic composite fine particles | Embedded |
| Comparative toner 3 | Toner particles 1 | External additive A13 | 1.5 Fumed silica | 1.5 | 142 | Organic-inorganic composite fine particles | Adhered to surfaces |
| Comparative toner 4 | Toner particles 1 | External additive A14 | 1.5 Fumed silica | 1.5 | 123 | Resin fine particles | — |
| Comparative toner 5 | Toner particles 1 | — | — Fumed silica | 1.5 | | — | — |

Example 1

As a device used for evaluation in this example, a magnetic one component type printer HP LaserJet Enterprise 600 M603dn (manufactured by Hewlett Packard, process speed: 350 mm/s) was used. By this evaluation device, the following evaluation was performed using the toner 1. The evaluation results are shown in Table 5.

[Evaluation of Developability]

A toner was filled in a predetermined process cartridge. A lateral pattern having a printing rate of 2% was printed on two sheets, and this printing was regarded as one job. By using a mode which is set so that the device is stopped once after one job is finished, and a next job is then started, an image forming test was performed on totally 7,000 sheets. The image density of a 10th sheet and that of a 7,000th sheet were measured. The evaluation was performed under normal-temperature and normal-humidity conditions (temperature: 25.0° C., relative humidity: 60%) and under high-temperature and high-humidity conditions (temperature: 32.5° C., relative humidity: 85%) which were severe conditions for developability. The image density was measured by measuring a reflection density of a 5-mm circular solid image by a Macbeth densitometer (manufactured by Macbeth) which was a reflection densitometer using an SPI filter. A larger value indicates a better developability.

Examples 2 to 10, and Comparative Examples 1 to 5

By the use of the toners 2 to 10 and the comparative tones 1 to 5, the evaluation similar to that of Example 1 was performed. The evaluation results are shown in Table 5.

TABLE 5

| | | Normal-temperature and normal-humidity conditions | | | | high-temperature and high-humidity conditions | |
|---|---|---|---|---|---|---|---|
| | | Image density | | Low-temperature | | Image density | |
| | Toner | 10th sheet | 7,000th sheet | fixability (° C.) | Transferability (%) | 10th sheet | 7,000th sheet |
| Example 1 | Toner 1 | 1.50 | 1.49 | 190 | 97 | 1.48 | 1.45 |
| Example 2 | Toner 2 | 1.48 | 1.47 | 185 | 97 | 1.47 | 1.45 |
| Example 3 | Toner 3 | 1.52 | 1.50 | 200 | 96 | 1.50 | 1.48 |
| Example 4 | Toner 4 | 1.47 | 1.46 | 190 | 95 | 1.46 | 1.45 |
| Example 5 | Toner 5 | 1.51 | 1.50 | 200 | 95 | 1.51 | 1.49 |
| Example 6 | Toner 6 | 1.47 | 1.45 | 185 | 96 | 1.45 | 1.43 |
| Example 7 | Toner 7 | 1.52 | 1.52 | 205 | 96 | 1.52 | 1.49 |
| Example 8 | Toner 8 | 1.46 | 1.42 | 190 | 88 | 1.44 | 1.28 |
| Example 9 | Toner 9 | 1.48 | 1.40 | 195 | 92 | 1.44 | 1.33 |
| Example 10 | Toner 10 | 1.46 | 1.42 | 205 | 93 | 1.42 | 1.35 |
| Comparative Example 1 | Comparative toner 1 | 1.45 | 1.41 | 180 | 96 | 1.44 | 1.19 |
| Comparative Example 2 | Comparative toner 2 | 1.43 | 1.36 | 210 | 85 | 1.43 | 1.35 |
| Comparative Example 3 | Comparative toner 3 | 1.42 | 1.35 | 210 | 81 | 1.41 | 1.05 |
| Comparative Example 4 | Comparative toner 4 | 1.46 | 1.39 | 200 | 77 | 1.45 | 1.23 |
| Comparative Example 5 | Comparative toner 5 | 1.48 | 1.45 | 230 | 95 | 1.47 | 1.34 |

[Evaluation of Low-Temperature Fixability]

A fixing device was modified so that a fixing temperature was arbitrarily set. By the use of the above device, the temperature of the fixing device was controlled every 5° C. in a range of from 180° C. to 230° C., and a halftone image was output on plain paper (90 g/m$^2$) so that the image density was from 0.6 to 0.65. The image thus obtained was reciprocatively rubbed 5 times by lens-cleaning paper with a load of 4.9 kPa, and by a lowest temperature at which the rate of decrease of image density after the rubbing from that before the rubbing is 10% or less, the low-temperature fixability was evaluated. A lower temperature indicates a better low-temperature fixability. The evaluation was performed under normal-temperature and normal-humidity conditions (temperature: 25.0° C., relative humidity: 60%).

[Evaluation of Transferability]

For transferability evaluation, a residual transfer toner on a photosensitive member after a solid black image was transferred was taken off by taping using a mylar tape. In this case, the Macbeth density of the mylar tape adhered to paper, the Macbeth density of a mylar tape adhered to paper on which a toner was transferred but not fixed, and the Macbeth density of a mylar tape adhered to virgin paper were designated by C, D, and E, respectively. In addition, the calculation was performed by the following formula in an approximate manner. The evaluation was performed under normal-temperature and normal-humidity conditions (temperature: 25.0° C., relative humidity: 60%). A larger value indicates a better transferability.

$$\text{Transferability (\%)}=\{(D-C)/(D-E)\}\times 100$$

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-012811 filed Jan. 26, 2016, which is hereby incorporated by reference herein in its entirety.

What is claimed is:

1. A toner comprising:

toner particles each containing a binder resin and a colorant; and an external additive, wherein:

the external additive comprises an external additive A containing a fine particle of a crystalline resin or a fine particle of a wax, the crystalline resin and the wax each have an urethane bond or an urea bond, and the melting point of the crystalline resin and the melting point of the wax are each from 50° C. to 130° C.

2. The toner according to claim 1, wherein the crystalline resin has a peak molecular weight of from 15,000 to 60,000.

3. The toner according to claim 1, wherein the crystalline resin is a crystalline polyester.

4. The toner according to claim 1, wherein the melting point of the crystalline resin and the melting point of the wax are each from 55° C. to 130° C.

5. The toner according to claim 1, wherein the crystalline resin and the wax each have the urethane bond.

6. The toner according to claim 1, wherein:

the external additive A is an organic-inorganic composite fine particle, the organic-inorganic composite fine particle comprises:

(i) the fine particle of the crystalline resin, and an inorganic fine particle embedded in the surface of the fine particle of the crystalline resin, or (ii) the fine particle of the wax, and an inorganic fine particle embedded in the surface of the fine particle of the wax, and in the organic-inorganic composite fine particle, the inorganic fine particle is partially exposed to the surface of the fine particle of the crystalline resin or to the surface of the fine particle of the wax.

7. The toner according to claim 6, wherein the inorganic fine particle is at least one type selected from the group consisting of a silica fine particle, an alumina fine particle, a titania fine particle, a zinc oxide fine particle, a strontium titanate fine particle, a cerium oxide fine particle, and a calcium carbonate fine particle.

8. An external additive for toner, comprising:

a fine particle of a crystalline resin or a fine particle of a wax, wherein:

the crystalline resin and the wax each have an urethane bond or an urea bond, the melting point of the crystalline resin and the melting point of the wax are each from 50° C. to 130° C., and the external additive for toner is an organic-inorganic composite fine particle, the organic-inorganic composite fine particle comprises:

(i) the fine particle of the crystalline resin, and the inorganic fine particle embedded in the surface of the fine particle of the crystalline resin, or (ii) the fine particle of the wax, and an inorganic fine particle embedded in the surface of the fine particle of the wax, and in the organic-inorganic composite fine particle, the inorganic fine particle is partially exposed to the surface of the fine particle of the crystalline resin or to the surface of the fine particle of the wax.

9. The external additive for toner according to claim 8, wherein the crystalline resin has a peak molecular weight of from 15,000 to 60,000.

10. The external additive for toner according to claim 8, wherein the crystalline resin is a crystalline polyester.

11. The external additive for toner according to claim 8, wherein the melting point of the crystalline resin and the melting point of the wax are each from 55° C. to 130° C.

12. The external additive for toner according to claim 8, wherein the crystalline resin and the wax each have the urethane bond.

13. The external additive for toner according to claim 8, wherein the inorganic fine particle is at least one type selected from the group consisting of a silica fine particle, an alumina fine particle, a titania fine particle, a zinc oxide fine particle, a strontium titanate fine particle, a cerium oxide fine particle, and a calcium carbonate fine particle.

* * * * *